United States Patent [19]

Foster

[11] Patent Number: 4,714,919

[45] Date of Patent: Dec. 22, 1987

[54] VIDEO DISPLAY WITH IMPROVED SMOOTH SCROLLING

[75] Inventor: Mark J. Foster, Stevensville, Mich.

[73] Assignee: Zenith Electronics Corporation, Glenview, Ill.

[21] Appl. No.: 635,385

[22] Filed: Jul. 30, 1984

[51] Int. Cl.[4] ..... G09G 1/16

[52] U.S. Cl. ..... 340/726; 340/814

[58] Field of Search ..... 340/726, 814

[56] References Cited

U.S. PATENT DOCUMENTS

| | | | |
|---|---|---|---|
| 3,643,252 | 2/1972 | Roberts | 340/726 |
| 4,342,991 | 8/1982 | Pope et al. | 340/726 |
| 4,360,805 | 11/1982 | Andrews et al. | 340/726 |
| 4,375,638 | 3/1983 | O'Keefe et al. | 340/726 |
| 4,404,554 | 9/1983 | Tweedy, Jr. et al. | 340/750 |
| 4,418,344 | 11/1983 | Brown | 340/726 |
| 4,489,317 | 12/1984 | Siga | 340/723 |

*Primary Examiner*—Marshall M. Curtis

[57] ABSTRACT

Smooth scrolling is provided in a video display terminal having a cathode ray tube (CRT) controller which, by itself, is only capable of discontinuous, jump scrolling. The start-of-display address modification technique of advancing the start-of-display a single row at a time is combined with a display vertical position control normally used for changing the position of the display on the CRT faceplate. By sequentially erasing the top scan line, moving the entire display up one scan line by means of the vertical position control, erasing the second scan line, restoring the vertical position control to its original value, and advancing the CRT controller start address by two scan lines, the character rows are scrolled upward in a smooth, continuous manner. This sequence of operations is repeated a predetermined number of times for each character line with the "wrap-around" feature of a video memory used to provide new information for the bottom scan line.

7 Claims, 8 Drawing Figures

FIG. 2
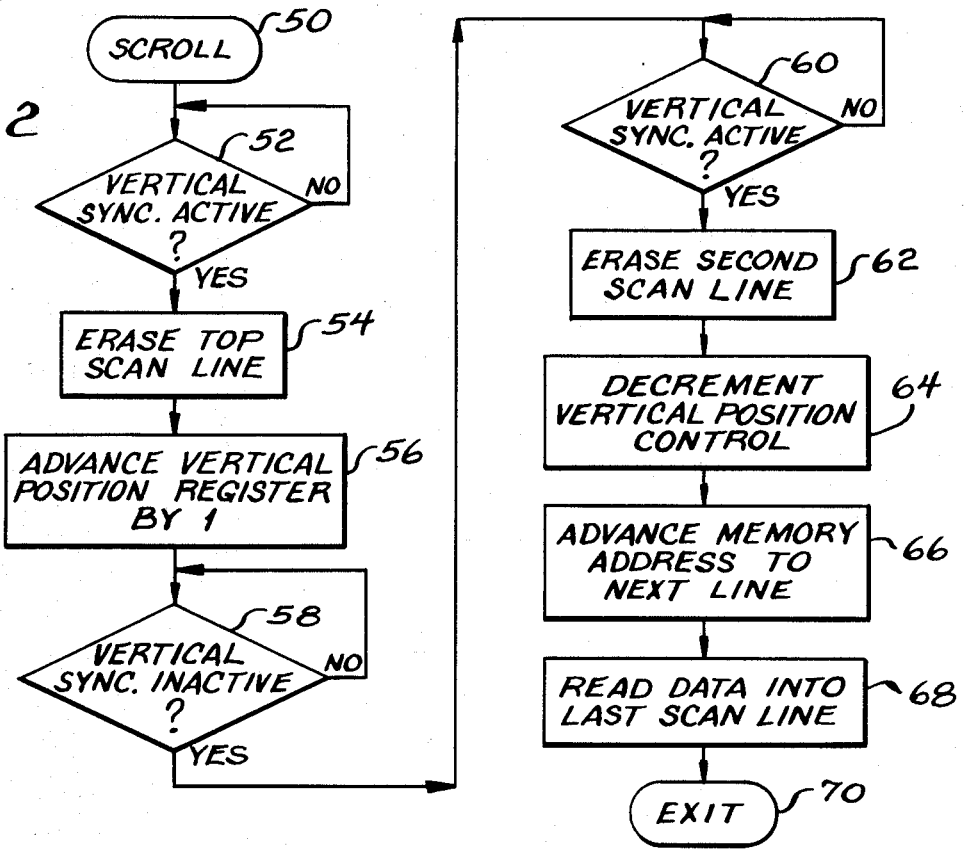
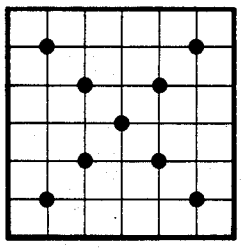
FIG. 3A
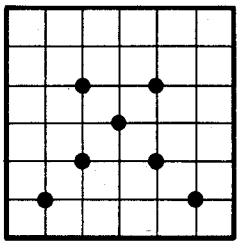
FIG. 3B
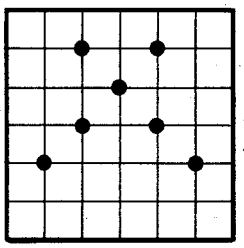
FIG. 3C
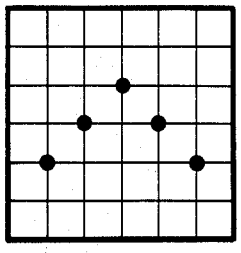
FIG. 3D
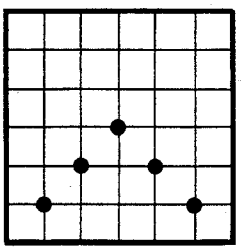
FIG. 3E
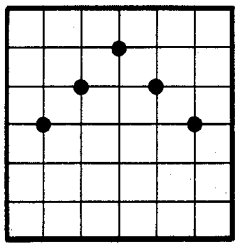
FIG. 3F

VIDEO DISPLAY WITH IMPROVED SMOOTH SCROLLING

BACKGROUND OF THE INVENTION

This invention relates generally to video display terminals and is particularly directed to the smooth, continuous scrolling of the display of a cathode ray tube.

The inside face of a cathode ray tube (CRT) is coated with phosphor, or a similar light-emitting substance, in the form of individual pixels, or dots, which glow when struck by an electron beam. A complete image is generated on the CRT's screen, or faceplate, by scanning the screen with an electron beam generally in a left to right direction as viewed from the front of the video display in an individual line sequence where the electron beam is deflected downward one line at the end of one sweep to again provide another sweep line from left to right. Thus, when the movement of the electron beam across one horizontal scan line is complete, it drops down to the next horizontal scan line and sweeps across this line from left to right. When the electron beam scan reaches the bottom of the CRT's screen, the electron beam is deflected from the lower right hand corner of the screen to the upper left hand corner thereof in a vertical deflection period. During this interval the electron beam is "off" and the vertical deflection of the beam is thus not seen by the viewer.

When utilized in a computer terminal, the video display on the CRT is accomplished by a mapping process wherein memory bits representing specific points on the CRT's screen are stored in a random access memory (RAM). Each memory bit has a logical value of 1 or 0 with each bit thus representing a light or dark spot at a particular location on the raster of the video display, depending on the bit's value.

In a typical computer terminal with a video display, each alphanumeric character may be thought of as occupying a rectangular "frame" on the CRT's screen. This "frame" may be defined by a rectangular matrix comprised of m by n pixels, or elemental dots. For example, a character "frame" may be 8 pixels high by 10 pixels wide. Within this frame there are $2^{80}$ possible patterns of pixels, where each pixel may be on or off. Thus, each character is 8 scan lines high. In a typical video display terminal there are approximately 200–256 scan lines which provide from 25 to 32 lines of text, or characters.

One limitation in all video display terminals is that the amount of information which can be presented at a given time is finite, i.e., there is a maximum number of characters associated with the video display. One solution to this problem is to use a technique known as "scrolling". Scrolling is a process which moves data on the video display upward or downward one line at a time, thus freeing a scan line of the display to provide more information. For example, in an upward scroll the top line of characters in the display is removed, the remaining lines are moved up one line, and a new line of characters is inserted at the bottom of the display.

Many different methods are used to achieve scrolling in video display terminals, but the most common involves the manipulation of the addresses being read from a video memory for presentation on the video display. For example, if the video display unit begins its display at the second line of video memory rather than the first line, the display will appear to have moved upwards, or scrolled, one line. Systems which utilize this approach are further divided into two classes: line-at-a-time, or "jump", scrolling and sub-line-at-a-time, or "smooth", scrolling. Smooth scrolling provides what its name implies—the information on the video display is moved in increments small enough to make the text appear to move smoothly from one line to the next.

With many commercially available test generators, it is not generally possible to perform smooth scrolling. These systems typically are limited by the number of character rows which they can handle, as compared to the number of scan lines, or vertical character segments, in the video display. If the video display terminal hardware is capable of generating as many rows as there are scan lines and if the controlling computer, or central processing unit (CPU), has access to the individual dots of a character, then it is possible to perform smooth scrolling by treating each character as a sequence of characters. For example, for a character ten pixels tall, the video display may be programmed so that ten rows of information are treated as a single character. These ten rows will then appear as a single character if the pixels corresponding to the character are turned on in the correct location of each of the rows. By advancing the start-of-display a single row at a time, the display will move only 1/10th of a character each time scrolling is performed. This results in the smooth upward scrolling of the information presented on the video display. Unfortunately, as mentioned above, many video display units do not have the capability of addressing as many character rows as there are scan lines in the video display and are thus not capable of smooth scrolling.

The prior art discloses a variety of video display terminal scrolling approaches. For example, U.S. Pat. No. 4,342,991 to Pope et al discloses a scrolling arrangement which makes use of an indirect address counter for addressing data in a refresh memory during the CRT blanking interval and a refresh address counter for addressing data in the refresh memory during other intervals. U.S. Pat. No. 4,375,638 to O'Keefe et al discloses a scrolling display refresh memory address generation apparatus for a video display controller having a row register and PROMs precoded to perform modular addition and multiplication for generating an address used to access the display controller refresh memory such that all but one stationary row of information on the display screen may be scrolled upward. U.S. Pat. No. 4,404,554 to Tweedy, Jr., et al makes use of a smooth scroll offset register 204 which may be programmed with an offset of 0 in the first frame, 1 in the second frame, 2 in the third frame and so forth until N scan lines have been offset where N is the number of scan lines per data row. At this point an entire data row will have been scrolled off the smooth scroll area and the row table must then be manipulated to move each of the remaining data rows up one position. The smooth scroll offset register is then returned to 0 and the sequence is then repeated if additional scrolling is desired. U.S. Pat. No. 4,418,344 to Brown makes use of a CPU interrupt during each vertical retrace interval to update parameter byte information related to the scan line on which the display of a character row is to commence and the number of scan lines of that character row which are to be displayed during the current frame. Updating of the parameter byte information permits the incrementing and/or decrementing of the first scan line number and the number of scan lines. These and other prior art approaches provide a smooth scrolling capability but at considerable expense. This additional expense may take the form of additional components such as additional registers or multiplexers or more memory capacity, all of which increase video display terminal complexity and cost.

The present invention is intended to overcome the aforementioned limitations of the prior art by providing an inexpensive smooth scrolling capability which may be easily incorporated in most video display terminals. The present invention makes use of conventional start-of-display address modification techniques in combination with the alternating changing of the position of the display by means of a vertical position control to provide smooth scrolling in a raster scanned video display terminal.

OBJECTS OF THE INVENTION

Accordingly, it is an object of the present invention to provide smooth, continuous scrolling of the video display in a computer terminal.

It is another object of the present invention to provide smooth scrolling in a video display terminal using an inexpensive cathode ray tube controller which in and of itself is incapable of smooth scrolling.

Yet another object of the present invention is to provide an inexpensive arrangement for the smooth scrolling of displayed information in a video display terminal without requiring the rewriting of large amounts of information in the refresh memory of the video controller.

A still further object of the present invention is to displace an image presented on a raster scanned video display device upward or downward on an apparently scan line by scan line basis.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, in which:

FIG. 2 is a flow diagram illustrating the operation of the smooth scrolling technique of the present invention; and FIGS. 3A–3F illustrate the sequential positioning of a character on a video display in accordance with the sequence of operations shown in FIG. 2 in smoothly scrolling the character upward on the video display.

DETAILED DESCRIPTION OF THE PREFERRED EMBODIMENT

Figure 1:
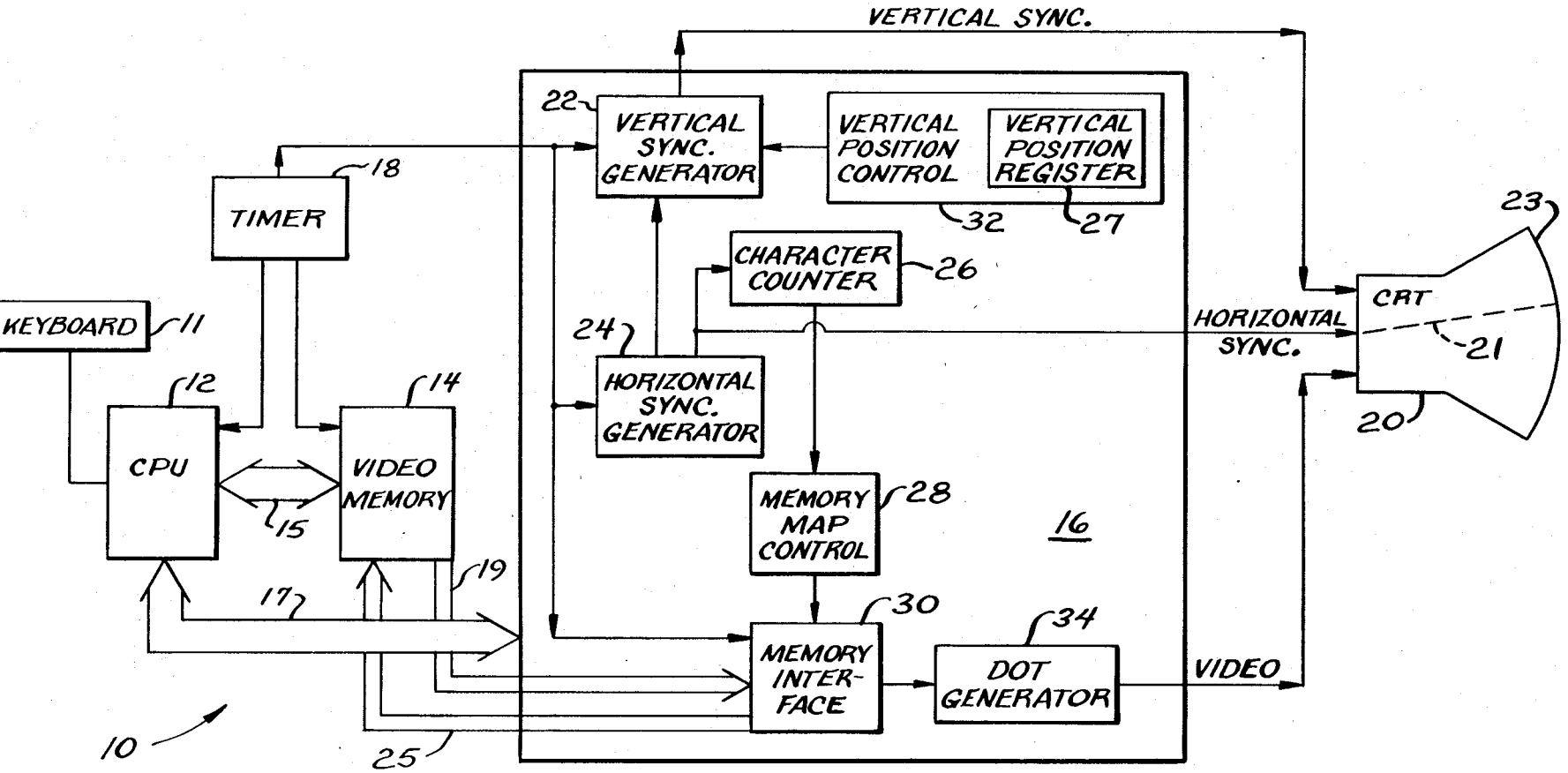
FIG. 1 is a simplified block diagram of a video display terminal incorporating smooth scrolling in accordance with the present invention.

Referring to FIG. 1, there is shown in simplified block diagram form a smooth scroll system 10 for a video display terminal in accordance with the present invention. User initiated inputs are provided to a central processing unit (CPU) 12 by means of a conventional input device such as a keyboard 11. The CPU 12 utilized in a preferred embodiment of the present invention is the 8-bit HMOS 8088 microprocessor available from Intel Corporation of Santa Clara, Calif. This microprocessor includes an 8-bit data bus interface capable of addressing up to a maximum of 1 megabyte of memory. The 8088 microprocessor is conventional in design and operation and is thus representative of the typical 8-bit microprocessor currently available. However, the present invention is not limited in its application to the use of the 8088 microprocessor, nor is it limited in operation to an 8-bit microprocessor, but will operate equally well with any conventional microprocessor regardless of word length.

The CPU 12 is coupled to a video memory 14 via a bidirectional data/address bus 15 and is capable of either writing data into or reading data from the video memory 14. Similarly, a CRT controller 16 is coupled to the video memory 14 via a data bus 19. Unlike CPU 12, the CRT controller 16 is only capable of providing addresses to the video memory 14 via an address/control bus 25 so that video information can be read from it. The video information stored in the video memory 14 is provided to the CRT controller 16 via the data bus 19.

In general, the video memory 14 stores all of the bit-patterns to be displayed via the CRT controller 16 on a cathode ray tube (CRT) 20. The CRT 20 is conventional in design and includes processing circuitry for receiving vertical and horizontal sync timing signals as well as video signals from the CRT controller 16 for controlling an electron beam 21 within the CRT 20. The electron beam 21 is directed upon the CRT's faceplate 23 which is coated with a phosphor, or a similar light-emitting substance, in the form of individual pixels which glow when struck by the electron beam 21. It is in this manner that a video image is formed on the faceplate 23 of the CRT 20.

Some of the bit patterns stored in the video memory 14 represent character images, whereas others may represent graphic images. The CPU 12 determines which patterns are to be displayed on the CRT 20 and modifies the video memory 14 to appropriately reflect these patterns. The various bit patterns may result from external data generated by devices such as a keyboard 11 or may be internally generated in response to a command such as to draw a line between two points on the faceplate, or screen, 23 of the CRT 20. Each address byte of the video memory 14 represents 8 pixels (or dots) of information on the CRT and, as such, represents part of the pattern used to display a character on the CRT 20, or part of some graphic image. The display memory contained in the video memory 14 is then sequentially accessed by using addresses provided by the CRT controller 16 and the digital patterns read from the video memory 14 are converted into corresponding video signals representative of the selected character patterns by the CRT controller 16 in driving the CRT 20.

The video memory 14 is comprised of a plurality of bytes, each of which represent 8 pixels on the CRT's screen. To display a pixel, the appropriate byte/bit combination in the video memory 14 must be modified. the address of this byte is provided from the CPU 12 to the video memory 14 via data/address bus 15.

The CRT controller 16 utilized in a preferred embodiment of the present invention is the 6845 CRT controller available from a number of sources. The CRT controller 16 generates the signals necessary to interface the digital system comprised of the CPU 12 and the video RAM 14 to the raster scanned CRT 20. The CRT controller 16 continuously updates the CRT's screen 23 sixty times per second (or fifty times per second in some parts of the world) based upon the contents of the address locations in the video memory 14. The CRT controller 16 generates a video RAM address signal which it provides to the video memory 14 via the address/control bus 25 and reads a byte representing 8 pixels on the CRT's screen from the video memory 14 via the data bus 19. Once these pixels are displayed, the CRT controller 16 automatically, depending upon its initialization parameters, advances to the next byte describing the next group of pixels with this process continuing without interruption.

Control/data signals transmitted via a CPU control address/data bus 17 from the CPU 12 to the CRT controller 16 specify such system parameters as CRT type, lines per screen to be displayed on the CRT, characters per line, and interrupt generation during the vertical sync interval. From FIG. 1, it can be seen that control and data signals are provided between the video memory 14 and both the CPU 12 and the CRT controller 16.

The CRT controller 16 includes various components for interfacing the CPU 12 and the video memory 14 with the CRT 20. Included in the CRT controller 16 are vertical and horizontal sync generators 22, 24 which are coupled to a system timer 18 and responsive to timed outputs therefrom for respectively providing vertical and horizontal sync pulses to vertical and horizontal deflection circuitry (not shown) within CRT 20 for driving the electron beam 21. The sync pulses ensure proper timing between the video information displayed and the position of the electron beam 21 on the CRT's faceplate 23. Thus, the vertical and horizontal sync generators 22, 24 function as counters in counting the received clock signals from the timer 18 and periodically providing vertical and horizontal sync pulses to the CRT 20. The vertical rate of the CRT is typically 60 Hz, while the horizontal rate is typically 15,750 Hz. These numbers respectively represent the vertical and horizontal sweep rates of the electron beam 21 across the CRT's faceplate 23.

A timing signal is also provided from timer 18 to the memory interface 30 within the CRT controller 16. The memory interface is coupled via the address/control bus 25 and the data bus 19 to the video memory 14 for presenting addresses to the video memory 14 and reading character data corresponding to these addresses from the video memory 14 via the data bus 19. The memory interface 30 thus provides control information to the video memory 14 via the address/control bus 25 for obtaining display information therefrom.

Horizontal sweep timing information is also provided from the horizontal sync generator 24 to a character counter 26. The character counter 26 outputs memory addresses representing the various characters to be displayed. In one embodiment of the present invention up to 2,000 different characters can be displayed upon the CRT 20. The memory address representing the character to be displayed is provided by the character counter 26 to a memory map control 28 which converts it to a corresponding address within the video memory 14 to which it is provided via the address/control bus 25 and the memory interface 30. The desired character is then read from the video memory 14 by the CRT controller 16 via the data bus 19 and is provided by the memory interface 30 to a dot generator 34 which converts the video memory address signal to a corresponding video signal which is then provided to appropriate video drive circuitry (not shown) within the CRT 20 for display on the faceplate 23 thereof. The video signal output from the dot generator 34 provides for illumination of the pixels representing the character to be displayed on the CRT 20.

A vertical position control 32 is also included in the CRT controller 16. The vertical position control 32 includes a vertical position register 27 which is responsive to timing outputs from the CPU 12 for adjusting the position of the entire video display on the CRT's faceplate 23 upward or downward. In response to a timing signal provided from the CPU 12 to the vertical position control 32 via the address/data bus 17, a timing signal is provided by the vertical position control 32 to the vertical sync generator 22 for controlling the operation thereof. The timing signal provided from the vertical position control 32 to the vertical sync generator 22 permits the occurrence of the vertical sync pulse to be advanced or delayed. Advancing the vertical sync pulse causes the video information displayed on the CRT 20 to be moved downward on its faceplate 23. Delaying the occurrence of the vertical sync pulse causes the video information displayed upon the CRT 20 to be moved upward on its faceplate 23. Thus, appropriately timed output signals from the CPU 12 to the vertical position control 32 permit the video information presented on the CRT 20 to be moved upward or downward as desired.

Referring to FIGS. 2 and 3A–3F, the operation of the smooth scroll system 10 to FIG. 1 will now be described in detail. FIG. 2 is a simplified flow chart illustrating the operations carried out by the smooth scroll system 10 under the control of CPU 12, while FIGS. 3A–3F show in simplified form the changes in the video display in the upward scrolling of an "X" in accordance with the procedure outlined in FIG. 2. In FIGS. 3A–3F, the letter "X" is shown for simplicity as a series of pixels in a $5\times5$ dot matrix. Each horizontal line represents an electron beam scan line. The present invention is not limited in application to characters presented in a $5\times5$ dot matrix, but is applicable to virtually any matrix-type individual character presentation. In addition, for simplicity the scrolling of only a single character is shown in FIGS. 3A–3F, it being understood that many such characters would be displayed and simultaneously scrolled in a typical raster scanned video display device.

The smooth scroll routine carried out under the control of the CPU 12 is entered at step 50 as shown in FIG. 2. The program stored in CPU 12 then determines whether the system is in a vertical sync interval during which the CRT's faceplate 23 is retraced by the electron beam 21. If a vertical sync interval is not detected at step 52, the program executes a delay in waiting for the occurrence of the next vertical sync interval. If at step 52 the CPU 12 determines that the system is now in a vertical sync interval, the program proceeds to step 54 wherein appropriate information is written from CPU 12 into the video memory 14 for erasing the contents of the top scan line of the CRT 20. This may be accomplished by the writing of 80 bytes of 0's into the video memory 14 by the CPU 12, where the first scan line is comprised of bytes 1–80 in the video memory. This is shown in FIG. 3B, where the top line of the character "X" shown therein has been erased. At step 56, the vertical position register is incremented, or advanced, by one scan line under the control of the vertical position control 32 in response to appropriate timing signals from the CPU 12. To accomplish this, the vertical position control 32 provides an appropriate timing signal to the vertical sync generator 22 in order to delay the occurrence of vertical sync the equivalent of one scan line. This causes the contents of the video display to be moved upward one scan line as shown in FIG. 3C. In a preferred embodiment, the procedures executed in steps 54 and 56 are carried out in rapid succession so as to occur nearly simultaneously.

At step 58, the program executed by the CPU 12 waits for the current vertical sync interval to finish and then proceeds to step 60. This is accomplished by the execution of a timing delay until the current vertical sync interval is over. At step 60, the program then waits for the occurrence of the next vertical sync interval and executes a delay until the next vertical sync interval is detected.

Following the detection of the next vertical interval, or pulse, at step 60, the program next erases the second scan line at step 62. This is accomplished in the present invention by the CPU 12 reading in 80 bytes of 0's into memory locations 80–159 in the video memory 14. Erasure of the second scan line on the video display is shown in FIG. 3D. Following erasure of the second scan line at step 62, the program then executes a decrementing of the vertical position control at step 64. the vertical position control 32 is adjusted to locate the displayed information in its original position as shown in FIG. 3A. The decrementing of the vertical position control is accomplished by advancing the occurrence of the vertical sync pulse by appropriate time adjusted signals provided by the vertical position control 32 to the vertical sync generator 22. Timing control of the vertical position control 32 is exercised by the CPU 12 via the address/data bus 17 as previously described. Decrementing of the vertical position control is shown in FIG. 3E wherein the remaining portion of the character shown therein has been moved downward one scan line.

At step 66, the CPU 12 advances the CRT start address to the next, or third, scan line which in the present example would be video memory byte 160. This causes the displayed information to be displaced upward one line as shown in FIG. 3F. Thus, with respect to FIG. 3A, the character displayed on the CRT appears to have been moved up two scan lines. After the memory address within the video memory 14 is advanced to the next scan line at step 66, new data is read into the start address of the last scan line at step 68 in order to update the contents of the last, or bottom, scan line as the display is scrolled upward. This updated data is provided from the CPU 12 to the video memory 14 from which it is read and provided to the CRT 20 by means of the CRT controller 16. In a preferred embodiment, the procedures executed in steps 62, 64 and 66 are carried out in rapid succession so as to occur substantially simultaneously. Thus, the video memory 14, in effect, continually rolls over on itself as the displayed data is displaced smoothly upward with the top line sequentially erased and the bottom line sequentially updated. The program under the control of the CPU 12 then exits the smooth scroll routine at step 70 to permit various other functions and operations to be executed in the video display terminal.

The sequence shown in FIG. 2 is repeated for each of the scan line groups which make up a character. For example, with scan line groups two lines in length and with each character eight scan lines tall, the sequence of events shown in FIG. 2 is repeated four times in order to give the appearance that an entire character line has been smoothly scrolled upward off of the faceplate of the CRT.

By coordinating the various changes in the information presented on the video display with the occurrence of a vertical sync pulse, the viewer is able to see the changes in the displayed information over an entire scan period. Thus, the various manipulations of the displayed information occur so rapidly and represent such small incremental changes to the displayed information that they appear to the viewer as continuous and nonincremental changes in the thus displayed information. These continuous, high speed and gradual changes to the displayed information appear to the viewer as the smooth upward scrolling of the video information presented on the CRT.

There has thus been shown an improved arrangement for the smooth scrolling of information presented on a raster scanned video display such as a CRT. By alternately erasing the contents of the top scan line of the display and moving the entire display upward by means of a vertical position control, the information on the video display appears to smoothly scroll upward in a continuous manner.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. In a video display system including a raster-scanned video display unit sequentially scanned by an electron beam for producing a video image thereon, wherein said video image is formed by a plurality of scan lines on said video display unit and wherein a vertical sync pulse occurs in a consistent pattern between sequential scans of said video display unit by said electron beam during a vertical retrace interval, a method for the continuous smooth scrolling of said video image on said video display unit comprising the sequence of stpes of:

detecting a first vertical sync pulse during a first vertical retrace interval;

erasing the contents of the first scan line of the video image during said first vertical retrace interval;

displacing the video image upward one scan line during said first vertical retrace interval;

detecting a second, next-subsequent vertical sync pulse during a second, next-subsequent vertical retrace interval;

erasing the contents of the second scan line of the video image during said second vertical retrace interval;

displacing the video image downward one scan line during said second vertical retrace interfal;

starting the next sequential scan of said display unit with a third scan line of said video image at the first line of the raster; and updating the last scan line of said video image.

2. The method of claim 1 further comprising the step of displacing the video image upward one scan line by executing a timing delay until said first vertical retrace interval is over prior to detecting said second vertical sync pulse.

3. The method of claim 2 wherein the step of displacing the video image downward one scan lin comprises advancing the occurrence of the second vertical sync pulse.

4. The method of claim 1 wherein the step of displacing the video image downward one scan line restores the video image to its original position on the video display unit.

5. The method of claim 1 wherein the steps of erasing the contents of the first scan line of the video image and displacing the video image upward one scan line are performed substantially simultaneously.

6. The method of claim 1 wherein the steps of erasing the contents of the second scan line of the video image and displacing the video image downward one scan line are performed substantially simultaneously.

7. The method of claim 1 wherein said video display unit includes a vertical position control and the step of displacing the video image upward includes incrementing said vertical position control and the step of displacing the video image downward includes decrementing said vertical position control.

* * * * *

UNITED STATES PATENT AND TRADEMARK OFFICE

CERTIFICATE OF CORRECTION

PATENT NO. : 4,714,919

DATED : December 22, 1987

INVENTOR(S) : Mark J. Foster

It is certified that error appears in the above-identified patent and that said Letters Patent is hereby corrected as shown below:

In claim 1, column 8, line 11 of the Patent change "stpes" to --steps--;

In claim 1, column 8, line 25 of the Patent change "interfal" to --interval--;

In claim 3, column 9, line 2 of the patent change "lin" to --line--.

Signed and Sealed this

Twenty-second Day of November, 1988

*Attest:*

DONALD J. QUIGG

*Attesting Officer*

*Commissioner of Patents and Trademarks*